United States Patent [19]

Steiner et al.

[11] Patent Number: 4,923,570

[45] Date of Patent: May 8, 1990

[54] LONG NIP PRESS ROLL ARRANGEMENT

[75] Inventors: Karl Steiner, Herbrechtingen; Andreas Schütte, Steinheim; Hans Flämig, Heidenheim, all of Fed. Rep. of Germany

[73] Assignee: J..M. Voith GmbH, Fed. Rep. of Germany

[21] Appl. No.: 318,171

[22] Filed: Mar. 2, 1989

[30] Foreign Application Priority Data

Mar. 12, 1988 [DE] Fed. Rep. of Germany ..... 3808293

[51] Int. Cl.[5] ..... D21F 3/02

[52] U.S. Cl. ..... 162/358; 162/205; 162/360.1

[58] Field of Search ..... 162/205, 305, 358, 360.1, 162/361, 272; 29/113.2, 116.2; 100/93 RP, 153

[56] References Cited

U.S. PATENT DOCUMENTS

| | | | |
|---|---|---|---|
| 4,086,131 | 4/1978 | Rempel et al. | 162/305 |
| 4,201,624 | 5/1980 | Mohr et al. | 162/20 S |
| 4,503,765 | 3/1985 | Schiel | 162/358 |
| 4,518,460 | 5/1985 | Hauser et al. | 100/153 |
| 4,552,620 | 11/1985 | Adams | 162/358 |
| 4,555,305 | 11/1985 | Steiner et al. | 162/20 S |
| 4,570,314 | 2/1986 | Holik et al. | 29/113 R |
| 4,625,376 | 12/1986 | Schiel et al. | 29/119 |
| 4,673,461 | 6/1987 | Roerig et al. | 162/20 S |

FOREIGN PATENT DOCUMENTS

| | | | |
|---|---|---|---|
| 79919 | 2/1971 | Fed. Rep. of Germany . | |
| 3030233 | 2/1982 | Fed. Rep. of Germany | 162/358 |

*Primary Examiner*—Karen M. Hastings

*Attorney, Agent, or Firm*—Ostrolenk, Faber, Gerb & Soffen

[57] ABSTRACT

A long nip press roll for removing water from a traveling fiber web. A rigid support beam has at least one recess in its periphery for receiving a radially movable hydraulically operated press shoe. A flexible tubular press shell is wrapped around the support beam and the press shoe. The concave outer surface of the press shoe presses the press shell against a backing roll for pressing upon a fiber web against a felt belt passing through the nip. The press shell has a smooth outer surface in contact with the web. At its outlet side from the press nip, the press shoe has a convexly curved guide surface over which the press shell and the paper web travel together and that guide surface is also wrapped for a distance by the felt belt. This separates the web from the felt belt and the web travels around on the press shell. A ledge inside the press shell and/or a removal roll at the outside of the press shell separate the web from the outside of the press shell. Plural press shoes defining plural press nips may be provided.

20 Claims, 4 Drawing Sheets

5a
5
E
23
10
21
22
16
17
20
3'
x
b
21
9
29
2
1
9
111
4
20
18
14
3
19
11
10
13
8
11
9a
7a
1'
11a
11b
7
15
112
12
6
30
a 11
11
20
15
11a
6
37
11
11
1
7a
7
9a
36
13
14
18
8
12a
3
21
29
5
20
4
112
19
16
30
21
20
41
35

LONG NIP PRESS ROLL ARRANGEMENT

BACKGROUND OF THE INVENTION

The present invention relates to a long nip press roll, particularly for use in machines for the manufacture of paper, cardboard, or the like, and, in particular, for removing water from a traveling paper web, and particularly to features of the press shell and press shoe which control the travel of the fiber web around the press shell.

The starting point of the invention is a long nip press roll in accordance with U.S. Pat. No. 4,555,305, incorporated herein by reference, or U.S. Pat. No. 4,673,461. The invention is preferably used in the first of these long nip press rolls. In that press roll, the two ends of the tubular press shell are fastened directly to support disks which are arranged coaxially with the press shell. For details, see U.S. Pat. No. 4,625,376, incorporated herein by reference. If the path of rotation of the press shell is to be eccentric with respect to the longitudinal axis of the support body, then, in accordance with German Patent Application No. P 37 08 189.6, which corresponds to U.S. application Ser. No. 164,542, filed Mar. 7, 1988, the two support disks are mounted in the same way eccentrically on the support body or support beam. Because of the direct attachment of the ends of the press shell to the two support disks, compressed air can be fed to the inside of the press shell so that its inside is continuously under a certain positive pressure. Furthermore, by means of springs, namely springs 21 in FIG. 1 of U.S. Pat. No. 4,625,376, which act upon the support disks, along the axial direction of the roll, the press shell can be placed under a certain axial stress between the disks. These measures cause the press shell to revolve quietly outside the elongate press nip on its substantially circular path, without mechanical support or guidance elements for guidance of the press shell being necessary outside the press nip.

Known long nip press rolls of this type have been used up to now predominantly for removing water from relatively thick paper webs. The paper web travels as a rule through the lengthened press nip between two felt belts. In that case, the press shell preferably has a relatively rough outer surface which contacts one of the felt belts. The present invention is concerned with the problem of permitting operation with only one felt belt, wherein the web of paper travels through the press nip between the felt belt and the press shell. This is in contrast to other known single felt arrangements in which the paper web travels through the press nip between the felt belt and the backing roll.

East German Patent No. 79,919 and U.S. Pat. No. 4,201,624 disclose long nip presses of a different type, in which the web of paper travels through the elongate press nip between a felt belt and an elastic press belt which travels around rolls. Those patents, however, disregard the difficulty, which is experienced particularly with relatively thin types of paper, of separating the paper web cleanly, i.e. as uniformly as possible over the width of the web, following its outlet from the press nip from the elastic press belt and at the same time of seeing that the danger of rewetting, i.e. flowing back of water from the felt belt into the paper web, is kept as slight as possible.

SUMMARY OF THE INVENTION

The object of the present invention is to provide a solution for this problem for long nip press rolls of this type.

The present invention concerns a long nip press roll used in the manufacture of paper and particularly for dewatering the fiber web which becomes paper. The long nip press roll includes a support body or beam that extends across the width of the roll transverse to the travel direction of the web through the press nip. At one radial outward side of the beam is defined a support means in the form of a shaped recess for supporting sealingly a floating press shoe that is carried in the recess and is hydraulically pushed radially outwardly against the interior of a press shell. A flexible, tubular press shell is wrapped around the beam and passes over the concavely curved outer guide surface of the press shoe to cooperate with the convexly curved periphery of a backing roll which backs the press shoe. The fiber web to be dewatered along with a felt belt are together guided through the elongate press nip, with the web contacting the felt belt at the backing roll side and contacting the press shell on the inner side. To help form the fiber web properly and to also enable subsequent separation of the fiber web from the press shell, the press shell has a smooth outer surface suitable for directly contacting the fiber web being dewatered.

After or downstream of the press nip, the press shoe has a substantially convexly curved guide surface and the felt belt is guided, by appropriate means like support rollers for the felt belt, so that once the felt belt passes the press nip together with the fiber web and the press shell, the felt belt travels at least over a substantial part of the convexly curved guide surface and thereafter separates from the press shell, with the fiber web remaining with the press shell while the felt belt continues on a separate pathway.

In the preferred embodiment, the radius of curvature of the guide surface of the press shoe is on the order of magnitude of, and is generally approximately the same as, the radius of the generally circular path of travel of the inflated rotating press shell.

It is necessary to separate the dewatered fiber web from the press shell after the felt belt has separated from the web. One technique is to place a guide ledge on the inside of the press shell at such a radial position that the guide ledge deforms the press shell outwardly around the guide ledge. This assists the separation of the web from the press shell so that it may be picked up by other means. In addition to or more likely as an alternative to the ledge, a removal roll is placed at the exterior of the press shell for removing the web. The removal roll may be tangent to the press shell or may be placed to slightly deform the press shell inwardly. Especially in the latter case, the press shell is free of mechanical guiding and supporting elements in the circumferential region where the removal roll presses into the press shell. The removal roll is preferably a suction roll so as to assuredly remove the web from the press shell.

During start up of the paper making machine, the fiber web is not removed or picked up, as explained above, but instead travels downward on the press shell. Therefore, a scraper is placed at the press shell downstream of the removal means to direct the web into a broke pit arranged beneath the press roll. To support the scraper, a guide ledge may be disposed on the inside of the press shell opposite the scraper.

The press shoe may be oriented in any practical orientation. For example, it may face upwardly or obliquely downwardly to move radially in the direction it faces. In the latter case, the direction of travel of the fiber web may extend obliquely upwardly through the elongate press nip.

A plurality of press shoes may be provided. Then the beam through the press shell would be provided with respective support means for each of the press shoes. The press shoes are separated circumferentially around the beam. In one preferred arrangement, two press shoes arranged approximately radially opposite each other around the beam. Three press shoes may be provided. A respective felt belt is provided for each of the nips at each of the press shoes. The web travels around the press shell from press nip to press nip.

FIGS. 3A and 5 of U.S. Pat. No. 4,552,620 show a press belt which travels over rolls. The outer side of the belt, like the inner side, is smooth, so that it can come into direct contact with the web of paper. The above indicated problem, however, is not mentioned in that patent and no solution for it is disclosed.

U.S. Pat. No. 4,570,314 discloses a long nip press roll, which, instead of a hydrodynamically lubricated press shoe, has a support element with at least one hydrostatic bearing pocket. Viewed in cross-section, convex guide surfaces having a radius of curvature which is adapted to the path of revolution of the press shell are provided on both sides of the hydrostatic bearing pocket. However, in that case, the web of paper travels through the elongate press nip between the felt belt and the backing roll. Thus, the above indicated problem is neither mentioned nor solved.

In the invention, after the press nip, the felt belt travels initially over a short, well defined distance together with the paper web and the press shell, at least over a substantial part of the convexly curved guide surface. A slight amount of remoistening must be tolerated in this case. However, this has the advantage that the side of the felt belt facing away from the paper web is aired immediately upon its emergence from the elongate press nip. This enables air to penetrate into the inside of the felt belt at a very early time, which assures that immediately following the point where the felt belt moves off the press shoe, the web of paper does not continue to travel with the felt belt but instead travels with the press shell.

The convexly curved guide surface which is present outside the elongate press nip, avoids, among other things, having the felt belt travel together with and on the surface of the press shell for a distance along the shell of the backing roll directly after their emergence from the press nip. If this travel together could not be prevented, then there would be the danger of increased remoistening of the paper web and the danger of uncontrolled separation of the paper web from the felt belt, i.e. part of the width of the paper web would separate earlier from the felt belt and another part would separate later. This would lead to overstressing of the still moist paper web and the danger of its tearing, particularly with thin types of paper.

The invention enables a long nip press roll to be used at that place in the paper machine where until now a hard roll with smooth surface, i.e. generally a stone roll, was necessary. Since stone rolls must be manufactured by a very expensive process, with the use of fragile natural granite, substantial simplification of the press section of a paper making machine is obtained by means of the present invention.

Other objects and features of the present invention will become apparent from the following description of the preferred embodiments of the invention considered in conjunction with the accompanying drawings.

DESCRIPTION OF THE PREFERRED EMBODIMENTS

Figure 1:
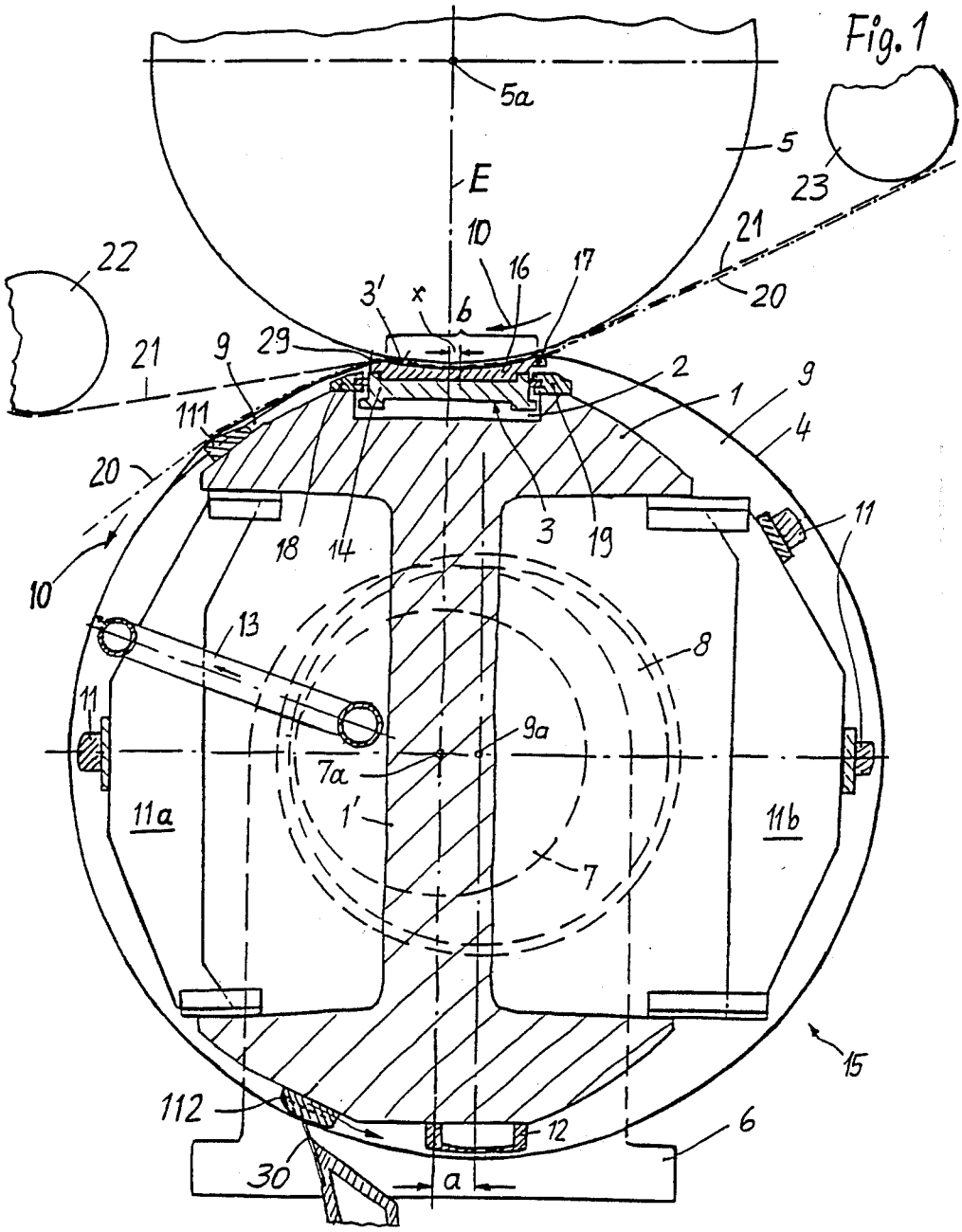
FIG. 1 shows a long nip press roll of the invention in cross-section.

The roll press shown in FIG. 1 comprises a long nip press roll 15 and a backing roll 5. A support body or beam 1 of I-shaped cross-section is arranged substantially symmetrically to the press plane so that at least the vertical web 1' of the support member 1 is symmetric with the press plane E. A recess 2 at the top of the beam 1 forms a hydraulic pressure chamber for a press shoe 3. It too is concentric to the press plane E. A press shoe 3 freely floats in the recess 2.

Around the support beam 1 and the press shoe 3, there travels a flexible, tubular, polyamide or the like material, press shell 4. Both the inner side and the outer side of the shell 4 are smooth, approximately in accordance with FIG. 3A of U.S. Pat. No. 4,552,620. Through the feeding of pressurized hydraulic fluid into the hydraulic pressure chamber 2, the press shoe 3 is pushed up in FIG. 1 against the inside of the press shell 4. The press shell 4, in turn, is thereby pressed up against the backing roll 5. The axis of rotation 5*a* of the backing roll 5 also lies in the press plane E, for symmetrical arrangement. The press shoe 3 has a concave, upper slide surface 3' which is generally adapted to the curvature of the backing roll 5, and to the length of the slide surface, in the cross-section shown which is designated b.

There is a bearing pedestal 6 for the support beam 1. The pedestal is also arranged symmetrically with the press plane E. The support beam 1 rests in the pedestal 6 via a centrally arranged journal 7, having a central axis 7*a*. Such journals and bearing pedestals are arranged on both ends of the support beam 1.

The longitudinal section in FIG. 1 of U.S. Pat. No. 4,625,376 shows preferred details for the invention described here, for instance, that the outside diameter of the support disks is only slightly smaller than the inside diameter of the press shell and that the press shell ends are fastened directly to the support disks and are centered on them.

An eccentrically developed bearing element 8 is provided on each of the two journals 7. A support disk for the press shell 4 is rotatably mounted on the element 8. The common axis of rotation 9A of the press shell 4 and of the two support disks 9 for the shell is arranged shifted by the distance e out of the press plane E in the direction opposite the direction of travel, shown by arrow 10, of the press shell over the slide surface 3' of the press shoe 3.

Auxiliary mounting ledges 11 are provided for the press shell 4 to slide over when the shell is pushed, upon assembly, onto the support body in a direction parallel to the axis. The auxiliary ledges 11 extend parallel to the axis 7A of the support member and are fastened on struts 11A and 11B which are supported on the beam 1. A suction channel 12 for a cooling and lubricating liquid is also arranged eccentrically. There is a feed device 13 for that liquid.

In FIG. 1, the path of travel of the press shell 4 deviates only slightly from a circular shape so that the inner space enclosed by the press shell can be sealed at both ends by means of the circular support disks 9. The press shell ends, as already mentioned, are preferably fastened directly on the support disks 9 so that the inside of the press shell can be acted on by compressed air.

Figure 2:
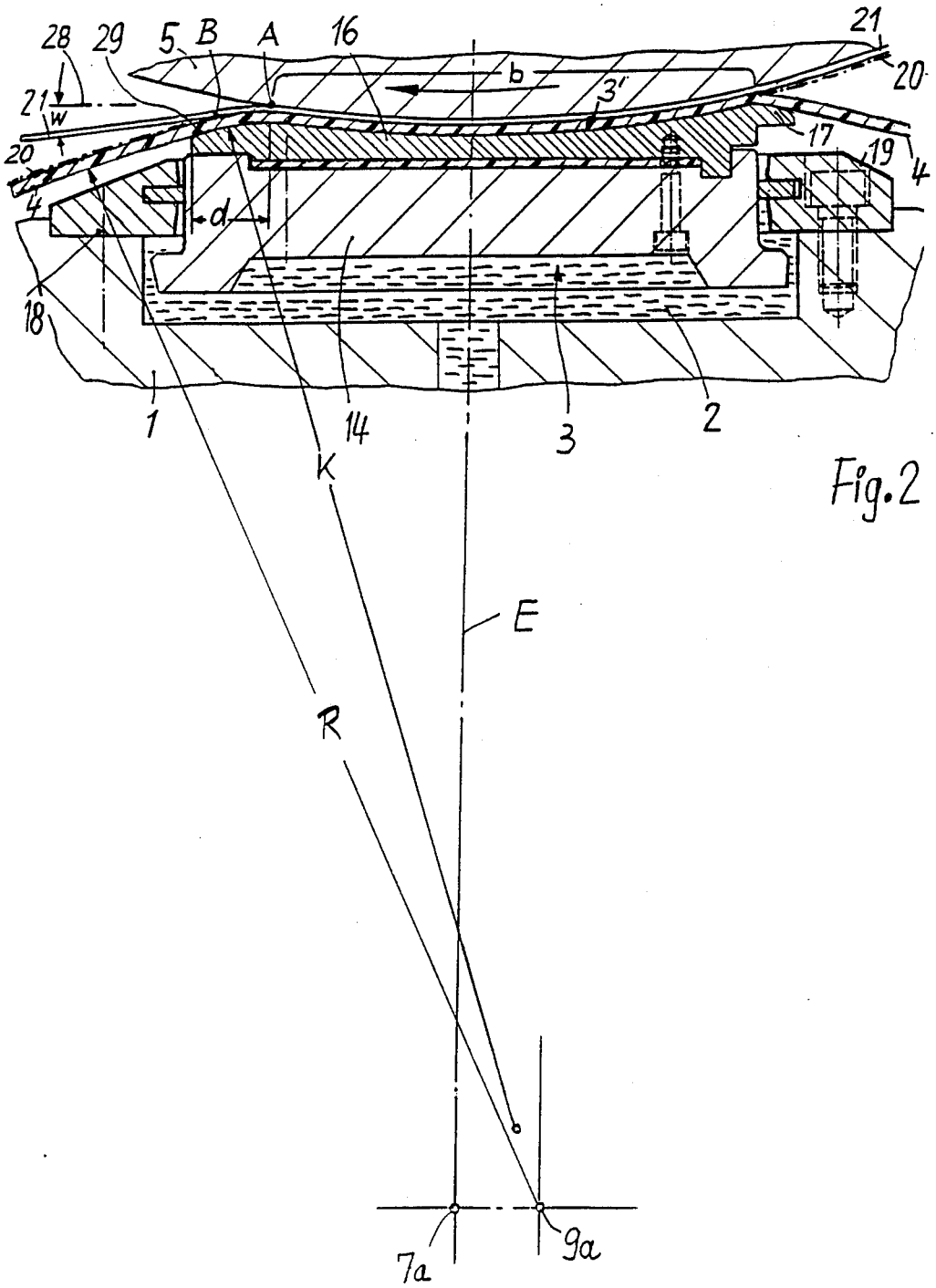
FIG. 2 shows a detail of FIG. 1 on a larger scale.

As seen in FIGS. 1 and 2, the press shoe 3 is developed in two parts, a lower part 14 and an upper part 16. The lower part 14 functions as a piston. In cross-section, it is developed substantially symmetrical with the press plane E. It is arranged within the pressure chamber 2. The upper part 16 carries the slide surface 3' and is arranged asymmetrically to the press plane E and thus asymmetric with the lower part 14. For this purpose, the upper part 16 is provided on the inlet side of the nip with an extension 17 which is located substantially within the path of travel of the press shell 4. The center of the slide surface 3' is thus offset by the distance e from the press plane E in the direction opposite the direction of travel of the press shell 4. The sealing ledges 18 and 19, together with their sealing ledge supports, guide the press shoe 3 and seal off the pressure chamber 2.

The width of the slide surface 3' is b. On the outlet side, to the left of the slide surface 3' in FIG. 1, the upper part 16 of the press shoe has a convexly curved guide surface 29 for engaging the press shell, as seen in FIG. 2. The radius of curvature K of the guide surface 29 can be approximately equal to the radius R of the path of travel of the press shell 4. However, the radius K can also be smaller than the radius R. The curvature of the guide surface 29 is preferably uniform. However, this need not be the case. For instance, a short length central part may be flat. As can be seen, the felt belt 21 travels together with the paper web 20 and the press shell 4 from the outlet end A of the press nip, a considerable distance over the guide surface 29. Not until point B, which is shortly in front of or before the outlet side end of the press shoe upper part 16, does the felt belt 21 lift off the paper web 20 and the press shell 4. The point B of lift off and the path traveled by the felt belt after it leaves the surface 29 is determined by a guide roll 22. The felt belt 21 is also guided into the nip by the guide roll 23. The felt belt separates from the backing roll at point A. Between points A and B, since the felt belt 21 is detached from the backing roll 5, air can enter the felt belt 21. As a result, the paper web 20 detaches itself from the felt belt 21 at the point B and travels along with the press shell 4. The necessary length of the path from A to B and thus the length of the guide surface 29, measured in the direction of travel of the web, should be determined by tests. The distance from A to B should be as short as possible in order to keep the remoistening of the paper web 20 from the felt belt 21 as slight as possible. On the other hand, the felt must be given sufficient time for airing. The length of the path from A to B should therefore be dependent inter alia on the porosity of the felt and the moisture level with which the felt 21 enters the press nip. The nature, e.g. the stiffness, of the press shell 4 may also play a role. As can be noted from FIG. 2, the length of the path from A to B can be determined by varying the angle W between the felt 21 and the plane 28 perpendicular to the press plane E. The length d of the guide surface 29 of the press shoe 3 and its shape, for instance, its radius of curvature K, is selected such that the point B always lies in the region where the press shell 4 is still in contact with the guide surface 29.

In FIG. 1, if the paper web 20 is to run off from the press shell 4 in the region following the press nip, and is to leave the shell in the form of a free paper pull, i.e., without the aid of a removal roll shown in FIG. 3, explained below, then a guide ledge 111, which extends parallel to the longitudinal axis of the support beam 1, can be provided on the support beam 1. Ledge 111 also has a convexly curved guide surface, which is shaped to press the press shell slightly outward. The press shell 4 thereby experiences a somewhat sharper curvature passing around the guide ledge 111 so that the paper web detaches itself more easily from the press shell 4 at this place. During the mounting of the press shell 4, the guide ledge 111 supports the press shell just like the auxiliary mounting ledges 11.

As is known from stone rolls, in the lower region of the press roll 15, there is a scraper 30 which serves primarily for removing any waste paper which may possibly result and remain on the press shell. In order that the scraper 30 not press the flexible press shell 4 inward, a guide ledge 112 is provided on the inside of the press shell, opposite the scraper 30. The convexly curved guide surface of the guide ledge 112 is substantially tangent to the circular path of travel of the press shell. The guide ledge 112 can have transverse holes or recesses so that the cooling liquid inside the press shell that is carried along by the press shell can pass by the guide ledge 112 in the circumferential direction.

Figure 3:
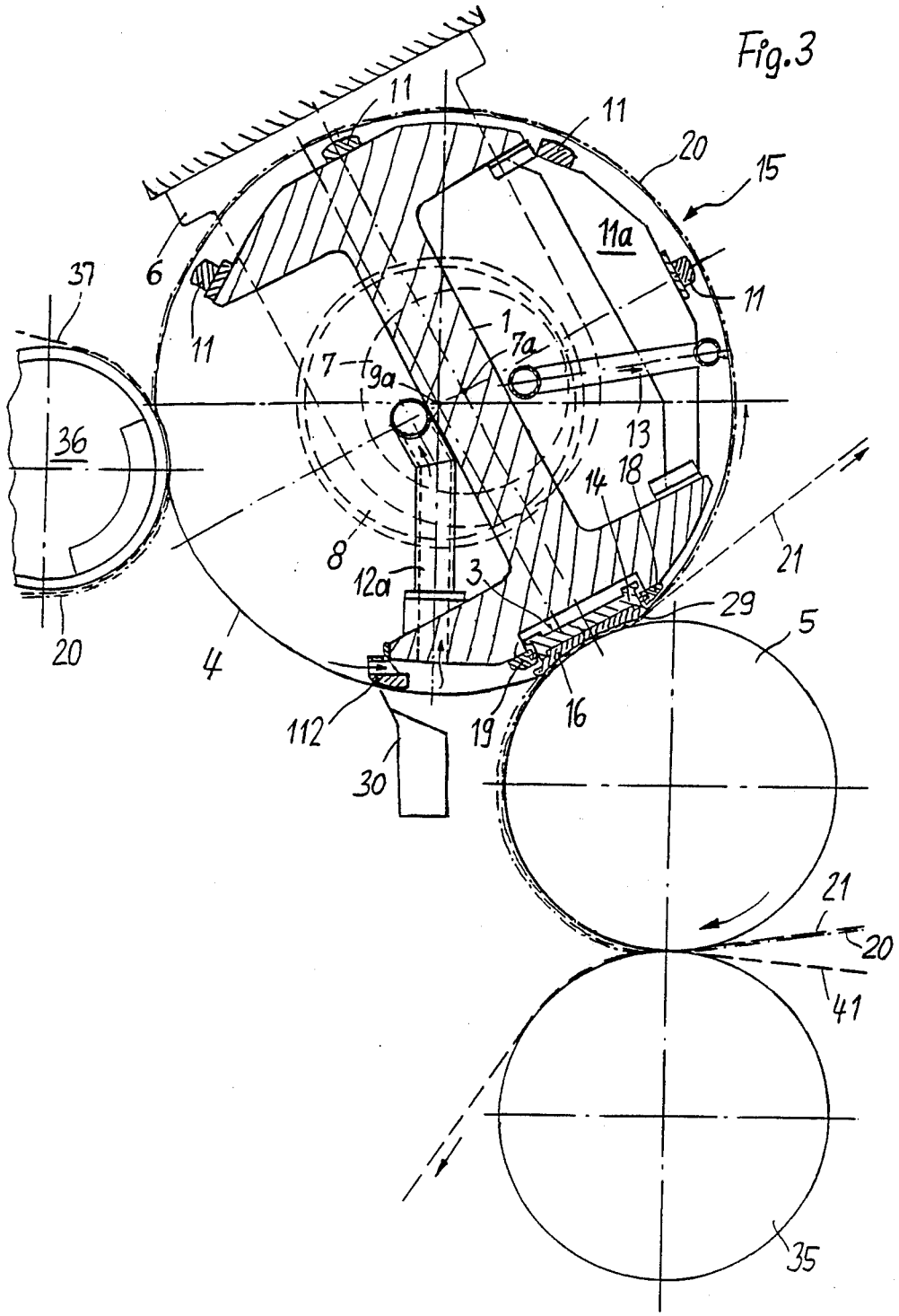
FIG. 3 shows a long nip press roll of the invention, also in cross-section, but in a modified arrangement as compared with FIG. 1.

FIG. 3 shows a three roll press section having three press rolls 35, 5 and 15 arranged one above the other. The paper web 20 first passes through the lower press nip together with two felt belts 21 and 41. The lower felt belt 41 then separates from the paper web 20, and the web travels, together with the upper felt belt 21, upward around the roll 5 and through the second press nip. The second nip is developed as an elongate press nip as in FIGS. 1 and 2, i.e. the upper press roll 15 corresponds essentially to the long nip press roll shown in FIG. 1. For this reason, all parts of the press roll 15 in FIG. 3, which are developed the same or at least approximately the same as corresponding elements in FIG. 1, have been provided with the same reference numbers. The arrangement in FIG. 3 is established so that the direction of action of the press shoe 3 of the long nip press roll 15 extends obliquely downward. As can be seen, the paper web travels obliquely upward through the elongate press nip. After emergence from that press nip, it remains adhered to the press shell 4 until it is removed from the press roll 15 in the downward extending region of the press shell 4 by means of a suction removal roll 36 and a conveyor belt 37. If necessary, the suction removal roll 36 can extend by a small amount into the circular path of the rotation of the press shell 4 or at least be tangent to the press shell 4. Due to the flexibility of the press shell 4, this is also possible, even if a conveyor belt 37 has been made endless by a relatively thick seam.

Based upon the radial direction of action of the press shoe 3, which is changed in FIG. 3 as compared with FIG. 1, the structure shown in FIG. 3 differs in the following points from that of FIG. 1. The auxiliary mounting ledges 11 are not arranged symmetrically on the two sides of the press nip but, once again, are arranged along the upper region of the path of travel of the press shell 4. In this connection, one of the two struts 11*b* present in FIG. 1 is dispensed with. For the discharge of the cooling and lubricant liquid, a plurality of suction pipes 12*a* are provided distributed along the support body.

As in FIG. 1, the upper, actually outer, part 16 of the press shoe 3 has a convexly curved guide surface 29 on its outlet end. Not only does the press shell 4 together with the paper web 3 move over that guide surface, but it is at least in part wrapped also by the felt belt 21. The felt belt 21 travels from the guide surface 29 to a felt guide roll 22, which is customary. The position of that roll 22 can be selected so that the desired wrapping of the guide surface 29 by the felt belt 21 is produced.

Figure 4:
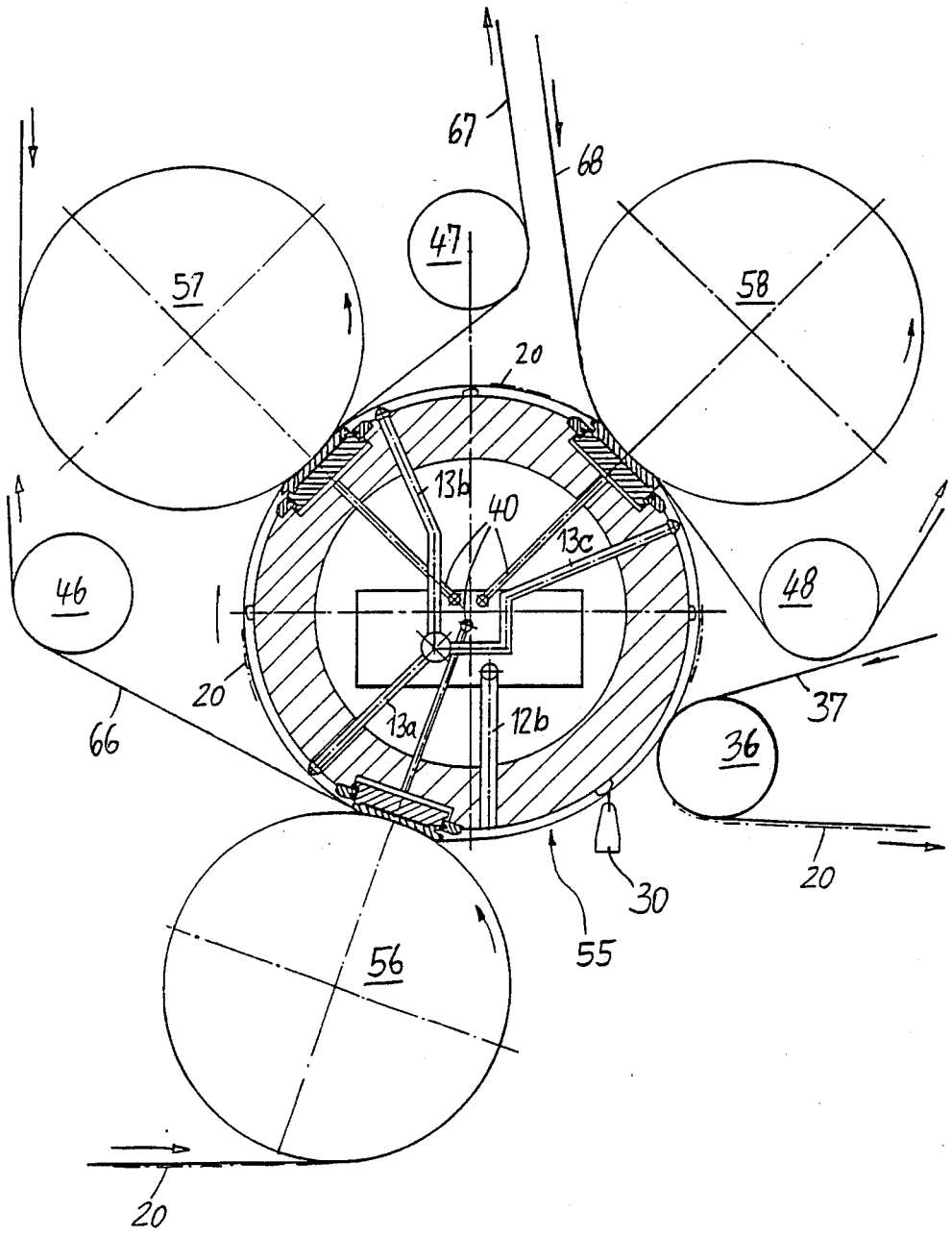
FIG. 4 shows a long nip press roll with three press shoes arranged distributed on the circumference, also in cross-section.

The long nip press roll 55 shown in FIG. 4 has three press shoes distributed over its circumference. Three press nips which act in succession on the same web are provided. One shoe acts obliquely downward while the other two act obliquely upward. Each shoe presses the press shell 4 against a respective backing roll, designated, in succession along the direction as they press the web 20, as rolls 56, 57 and 58. Around each of the backing rolls there travels respective felt belts 66, 67 and 68. Following the corresponding press nips, each of the felt belts travels over guide rolls 46, 47, 48, respectively. Those rolls are so placed that the respective felt belts, shown in FIGS. 1 and 2, wraps for a distance around the outlet guide surface of the press shoe. The removal roll 36 and the conveyor belt 37 are provided as is the scraper 30.

Within the long nip press roll 55 there can be noted three feed conduits 13*a*, 13*b* and 13*c* for cooling and lubricating liquid which extend from a main conduit. Each of those conduits sends liquid inside the shell. A suction line 12*b* is for liquid removal at the bottom of the roll 55 inside the shell 4. The pressure oil lines 40 in FIG. 4 lead to the pressure chambers. These lines have been omitted in FIGS. 1 and 3. Differing from FIG. 4, a long nip press roll according to the invention, can have two press shoes which lie diametrically opposite each other and cooperate with two backing rolls.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A long nip press roll arrangement in a machine for manufacturing fibrous material including paper and cardboard, for removing water from a traveling fiber web, the long nip press roll arrangement comprising:

a stationary support beam extending through the roll and across the travel direction of the web;

a flexible tubular press shell around the support beam and being movable therearound on an at least approximately circular path, the press shell extending across the travel direction of the web;

a backing roll having a substantially convex curvature;

means on the exterior of the support beam inside the press shell for supporting a press shoe; a radially displaceable press shoe supported at the press shoe support means on the beam, and means in the beam for acting upon the press shoe for urging the press shoe radially outwardly to press against the press shell toward the backing roll;

the press shoe having a concavely curved support surface concavely curved generally according to the convex curvature of the backing roll so that the concave surface of the press shoe being urged against the press shell and the press shell in turn being urged toward the backing roll, an elongate press nip is formed between the press shell and the backing roll;

a single felt dewatering belt which travels through the press nip together with the web;

the press shoe having a substantially convexly curved guide surface formed thereon and facing toward the press shell and located past the elongate press nip in the travel direction of the web; means for guiding the felt belt after it travels through the press nip together with the web and the press shell, so that the felt belt travels over at least a substantial part of the convexly curved guide surface of the press shoe; and means for guiding the web to pass through the press nip between the felt belt and the press shell and directly in contact with the press shell.

2. The long nip press roll arrangement of claim 1, wherein said means for guiding the felt belt is spaced away from the press roll and beyond the downstream side of the press nip.

3. The long nip press roll arrangement of claim 1, wherein the press shell has a smooth outer surface suitable for directly contacting the fiber web passing through the elongate press nip between the felt belt and the press shell.

4. The long nip press roll arrangement of claim 1, wherein the convexly curved guide surface includes at least a portion with a radius of curvature which is approximately the same radius of curvature as the travel path of the press shell.

5. The long nip press roll arrangement of claim 4, further comprising a guide ledge supported by the beam inside the press shell and extending in an axial direction through the roll transversely to the travel direction of the web, the ledge including a guide surface radially spaced out from the axis of rotation of the press shell by a slightly greater distance than the radius of the path of travel of the press shell, which guide surface slightly deforms the press shell outwardly at the guide ledge and aids separation of the web from the press shell.

6. The long nip press roll arrangement of claim 1, further comprising a guide ledge supported by the beam inside the press shell and extending in an axial direction across the roll transversely to the travel direction of the web, the ledge including a guide surface radially spaced out from the axis of rotation of the press shell by a slightly greater distance than the radius of the path of travel of the press shell, which guide surface slightly deforms the press shell outwardly at the guide ledge and aids separation of the web from the press shell.

7. The long nip press roll arrangement of claim 6, wherein the guide surface of the guide ledge is convexly curved.

8. The long nip press roll arrangement of claim 1, further comprising removal means for removing the fiber web from the press shell after passage of the web through the press nip.

9. The long nip press roll arrangement of claim 8, wherein the removal means comprises a removal roll supported at the press shell for removing the fiber web from the press shell.

10. The long nip press roll arrangement of claim 9, wherein the press roll includes mechanical guide elements which would prevent the shell from collapsing radially inwardly and the press shell has regions where it is free of the mechanical guide elements, the removal roll being arranged in a circumferential region around the press shell which is free of mechanical guide elements; the removal roll engaging the press shell.

11. The long nip press roll arrangement of claim 10, wherein the removal roll presses into and slightly deforms inwardly the press shell.

12. The long nip press roll arrangement of claim 10, wherein the removal roll is a suction roll.

13. The long nip press roll arrangement of claim 9, wherein the removal roll is tangent to the path of travel of the press shell.

14. The long nip press roll arrangement of claim 9, wherein the removal roll is a suction roll.

15. The long nip press roll arrangement of claim 1, further comprising a scraper positioned at the outer surface of the press shell after the location at which the web and the felt belt are separated from the press shell for scraping any remaining web material from the press shell.

16. The long nip press roll arrangement of claim 15, further comprising a guide ledge supported on the beam on the inside of the press shell opposite the scraper for supporting the press shell against force exerted thereupon by the scraper.

17. The long nip press roll arrangement of claim 1, wherein the press roll and press shoe are oriented so that the press shoe is radially movable in a direction obliquely downward; the felt belt guiding means guiding the felt belt to extend obliquely upwardly through the elongate press nip.

18. The long nip press roll arrangement of claim 1, further comprising second means on the beam for supporting a second press shoe; and a second press shoe being supported on the beam at a location circumferentially spaced from the first support means and the first support shoe and structured for defining a second elongate press nip in cooperation with a respective second backing roll.

19. The long nip press roll arrangement of claim 18, further comprising a third press shoe support means in the beam and a third press shoe supported in the third support means and being radially movable and structured for cooperating with a respective third backing roll.

20. The long nip press roll arrangement of claim 18, further comprising a respective felt belt for each of the press shoes for passing through the respective elongate press nips at each of the press shoes while the web travels along the press shell from elongate press nip to elongate press nip.

* * * * *